US007427055B2

(12) United States Patent
Platt

(10) Patent No.: US 7,427,055 B2
(45) Date of Patent: Sep. 23, 2008

(54) MOUNTING BRACKET AND SNAP-ON COVER ASSEMBLY FOR USE THEREWITH

(76) Inventor: Robert E. Platt, 8701 Highland Ave., Mineral Ridge, OH (US) 44440

( * ) Notice: Subject to any disclaimer, the term of this patent is extended or adjusted under 35 U.S.C. 154(b) by 89 days.

(21) Appl. No.: 11/301,555

(22) Filed: Dec. 13, 2005

(65) Prior Publication Data

US 2007/0131920 A1 Jun. 14, 2007

(51) Int. Cl.
*E04H 17/14* (2006.01)

(52) U.S. Cl. ..... 256/65.06; 256/65.05

(58) Field of Classification Search ... 256/65.01–65.07, 256/65.09, 66
See application file for complete search history.

(56) References Cited

U.S. PATENT DOCUMENTS

| | | | | |
|---|---|---|---|---|
| 1,258,460 | A | 3/1918 | Rees | |
| 2,402,407 | A * | 6/1946 | Jakeway | 292/347 |
| 2,587,912 | A * | 3/1952 | Simpson | 248/221.11 |
| 3,385,567 | A * | 5/1968 | Case et al. | 256/24 |
| 3,428,300 | A * | 2/1969 | Sconzo | 256/59 |
| 3,524,627 | A * | 8/1970 | Boyanton et al. | 256/65.06 |
| 4,087,141 | A * | 5/1978 | Roberts | 312/348.6 |
| 4,114,861 | A * | 9/1978 | Long | 256/67 |
| 4,301,828 | A * | 11/1981 | Martin, Jr. | 137/381 |
| 5,026,028 | A * | 6/1991 | Ooi et al. | 256/67 |
| 5,178,353 | A * | 1/1993 | Huxtable | 248/222.52 |
| 5,718,454 | A * | 2/1998 | Harrod | 280/756 |
| 5,788,224 | A * | 8/1998 | Platt | 256/66 |
| 5,873,671 | A * | 2/1999 | West | 403/232.1 |
| 5,971,365 | A | 10/1999 | Pigott et al. | |
| 6,039,307 | A | 3/2000 | De Zen | |
| 6,543,751 | B1 * | 4/2003 | Spruill | 256/65.04 |
| 6,805,335 | B2 | 10/2004 | Williams | |
| 6,893,008 | B2 | 5/2005 | Forbis | |
| 6,948,704 | B2 | 9/2005 | Forbis et al. | |
| 7,007,363 | B2 | 3/2006 | Forbis | |
| 7,048,259 | B2 * | 5/2006 | Quaintance et al. | 256/65.06 |
| 2003/0164486 | A1 * | 9/2003 | West | 256/65.1 |
| 2004/0026679 | A1 * | 2/2004 | Terrels et al. | 256/65.06 |
| 2004/0026680 | A1 * | 2/2004 | Williams | 256/65.06 |
| 2004/0206028 | A1 * | 10/2004 | Tarrels et al. | 52/287.1 |
| 2005/0236612 | A1 * | 10/2005 | Platt | 256/67 |
| 2006/0175594 | A1 * | 8/2006 | Burkart et l. | 256/65.02 |
| 2006/0202184 | A1 * | 9/2006 | Tamez et al. | 256/47 |
| 2006/0273296 | A1 * | 12/2006 | Platt | 256/65.01 |

* cited by examiner

*Primary Examiner*—Daniel P. Stodola
*Assistant Examiner*—Joshua T Kennedy
(74) *Attorney, Agent, or Firm*—Sand & Sebolt

(57) ABSTRACT

A bracket assembly for securing a rail to a post. The bracket assembly includes a bracket that is secured to the post and a spring-biased cover plate. The cover plate includes a perimeter wall that includes a slot which extends from its front edge through to its back edge. A portion of the perimeter wall terminates adjacent either side of the slot. These portions of the perimeter are movable relative to each other. The bracket includes a back wall with a peripheral outer wall extending upwardly and outwardly away therefrom. The peripheral wall defines a rail receiving receptacle into which an end of a rail is placed. The rail is preferably secured in position by a plurality of fasteners inserted through the rail and into the housing. Once the end of the rail is retained in the bracket, the terminal portions of the perimeter wall are arcuately separated from each other and the cover plate is snap-fitted over the peripheral outer wall of the bracket.

18 Claims, 9 Drawing Sheets

MOUNTING BRACKET AND SNAP-ON COVER ASSEMBLY FOR USE THEREWITH

BACKGROUND OF THE INVENTION

1. Technical Field

This invention generally relates to fencing systems. More particularly, the invention relates to mounting brackets useful for installing horizontal rails to vertical posts. Specifically, the invention relates to a bracket for mounting a rail to a post in confined spaces and to a cover plate that snaps around the bracket once the rail has been retained within the bracket.

2. Background Information

It has become more common in recent years to use either vinyl or plastic products for constructing fences for yards or deck railings. While vinyl fencing is aesthetically pleasing and easy to maintain, the material poses somewhat of a problem for the contractor who must connect the various components together. It is especially problematic to connect horizontal vinyl rails to vertically extending posts in confined spaces.

There is therefore a need in the art for an improved bracket assembly for attaching horizontal rails to vertical posts.

SUMMARY OF THE INVENTION

The mounting bracket assembly of the present invention comprises a bracket that is secured to a vertical fence post and a cover plate that is snap-fitted over the bracket after the rail has been retained within the bracket. The bracket is preferably substantially U-shaped and is mounted in such a way that it is open at a top end. The rail is dropped into the U-shaped bracket and fasteners are used to secure the rail within the bracket. The cover plate is snap fitted over the bracket after the rail has been retained therein so as to conceal the fasteners. The cover plate provides an aesthetically pleasing finish to the connection between the post and rail.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
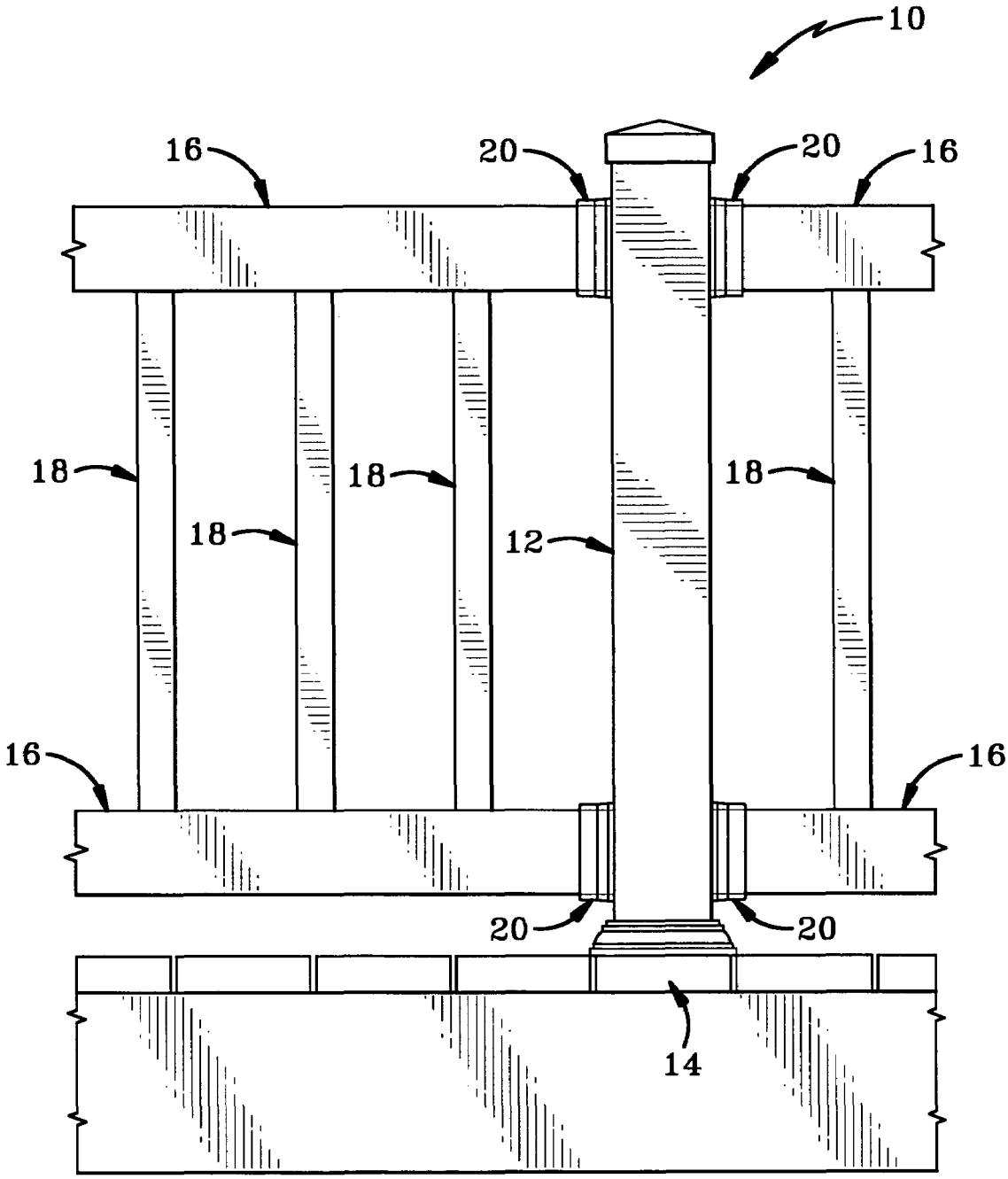
FIG. 1 is a front elevational view of a deck railing incorporating the mounting bracket assembly of the present invention.
Figure 2:
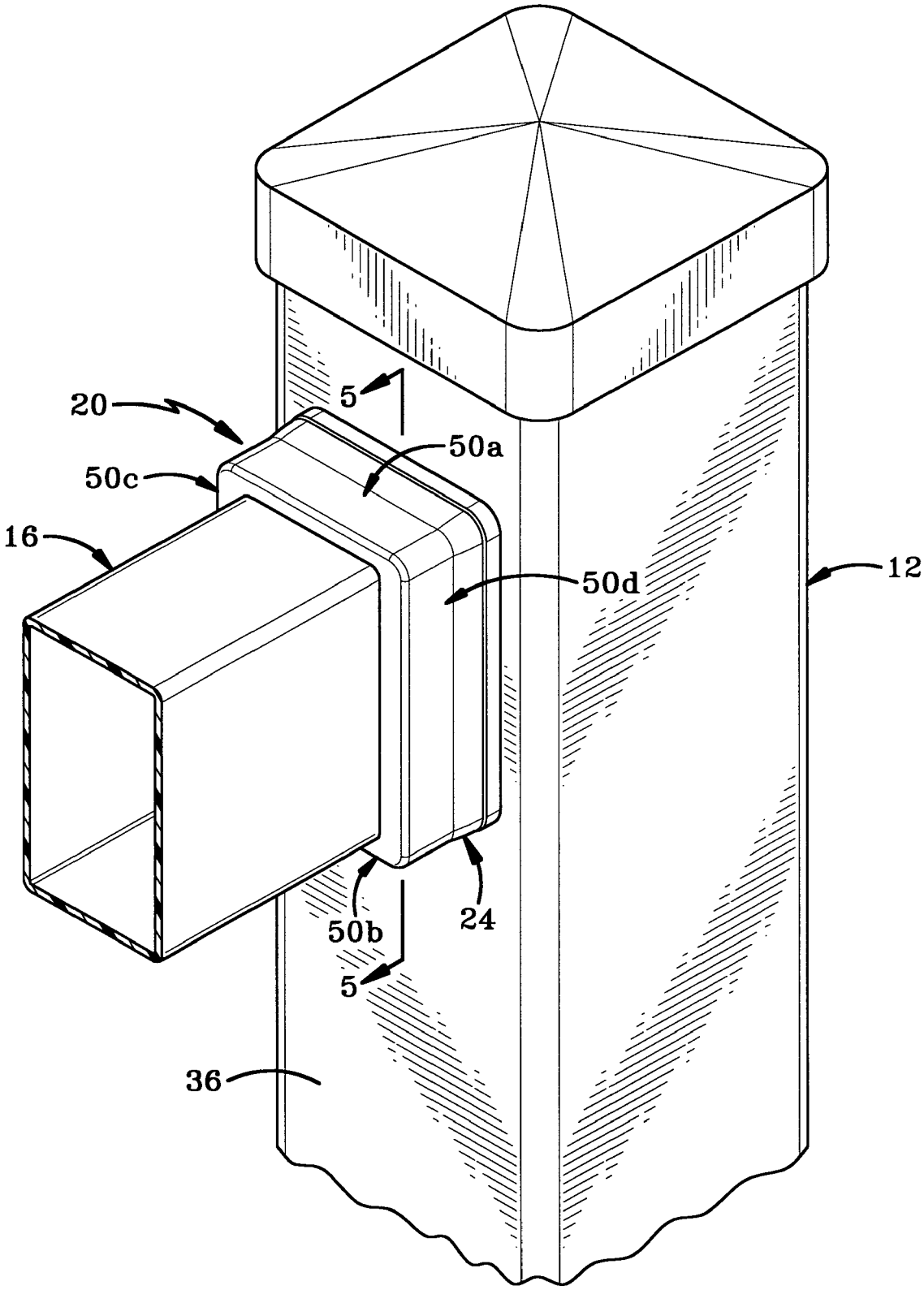
FIG. 2 is a partial perspective view of a rail secured to a post using a first embodiment of a mounting bracket assembly in accordance with the present invention.

Referring to FIGS. 1&2, there is shown a section of a deck railing 10 including a post 12, mounted to deck planking 14, and having a plurality of rails 16 secured thereto. A plurality of balusters 18 extend between the upper and lower rails 16. Rails 16 are secured to post 12 by way of mounting bracket assemblies in accordance with the present invention and generally indicated at 20.

Referring to FIGS. 3-9, there is shown a rail 16 connected to a post 12 by way of the mounting bracket assembly 20 in accordance with the present invention. Bracket assembly 20 comprises a bracket 22 and a cover plate 24.

Figure 3:
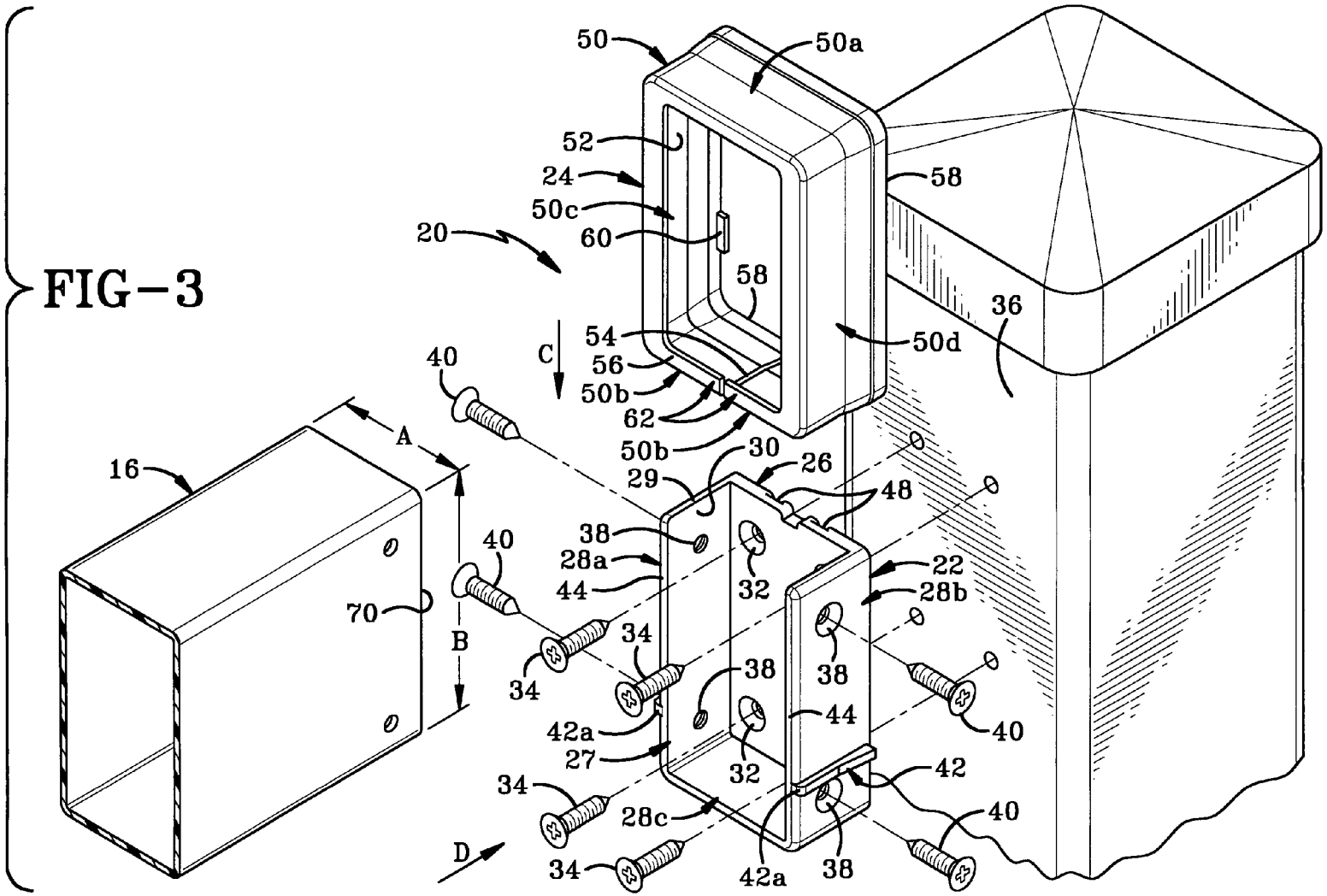
FIG. 3 is an exploded perspective view of the rail and post shown in FIG. 2.

In accordance with a specific feature of the present invention, bracket 22 has a back wall 26, a peripheral outer wall 28 extending outwardly away from the back wall 26 and having an opening 30 formed therein. Opening 30 preferably extends entirely across one end of bracket 22. Peripheral outer wall 28 is substantially U-shaped with the opening 30 therein extending from side section 28*a* across to side section 28*b* (FIG. 3). Back wall 26 of bracket 22 is also substantially U-shaped. Back wall 26 and peripheral outer wall 28 of bracket 22 substantially define a U-shaped receptacle 27 into which rail 16 may be received. Bracket 22 is complementary shaped and sized to receive an end of rail 16 therein. The distance between side sections 28*a* and 28*b* is therefore substantially equal to the width "A" of rail 16; and the distance between end section 28*c* and edge 29 is substantially equal to the height "B" of rail 16. It should, however, be understood that the bracket could alternatively be sized and shaped to receive rail 16 therein when it is turned through 90 degrees. In that instance, the distance between side sections 28*a* and 28*c* would have to be substantially equal to the height "B" of rail 16 and the distance between end section 28*c* and edge 29 would have to be substantially equal to the width "A" of rail 16. No matter which way rail 16 is to be oriented, an end of rail 16 is received within receptacle 27 in bracket 22. So, as is shown in FIG. 3, rail may be dropped or slid vertically into receptacle 27 through opening 30 (i.e., in the direction of arrow "C") or, if space provides, may be slid horizontally into receptacle 27 in the direction of arrow "D". Bracket 22 has a longitudinal axis "E-E" that runs substantially parallel to post 12 and a horizontal axis "F-F" that runs perpendicular to post 12.

Back wall 26 of bracket 22 defines a plurality of first apertures 32 therein. A plurality of first fasteners 34 are received through first apertures 32 to secure bracket 22 to a side wall 36 of post 12. Peripheral outer wall 28 defines a plurality of second apertures 38 therein. Second apertures 38 are provided to receive second fasteners 40 therethrough in order to secure rail 16 in shear within bracket 22. Side sections 28*a*, 28*b* of peripheral outer wall 28 preferably are also each provided with a flange 42 which extends from an outer edge 44 of bracket 22 through to a short distance inwardly from back wall 26 thereof. Flanges 42 preferably taper forwardly from back wall 26 through to outer edge 44 (FIG. 3). Outer edge 44 of peripheral outer wall 28 is preferably beveled and the beveling may include a front end 42*a* of flanges 42. End section 28*c* (FIG. 4) of peripheral outer wall 28 may also be provided with a pair of spaced apart ridges 46 thereon and a pair of notches 48 are provided at a top end of back wall 26. The purpose of ridges 46 and notches 48 will be described hereinafter.

Figure 4:
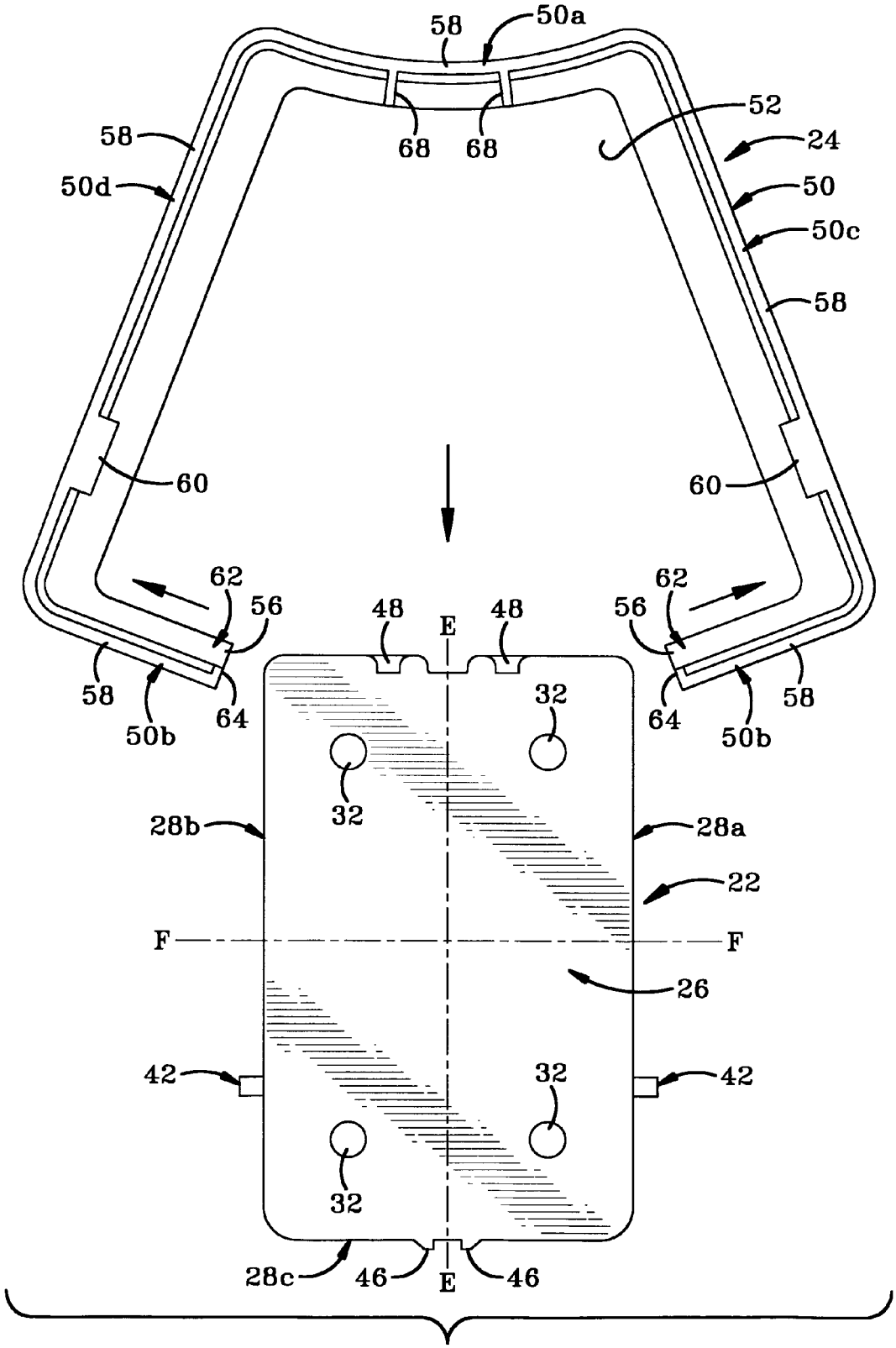
FIG. 4 is a rear view of the cover plate being snap-fitted over the bracket.
Figure 5:
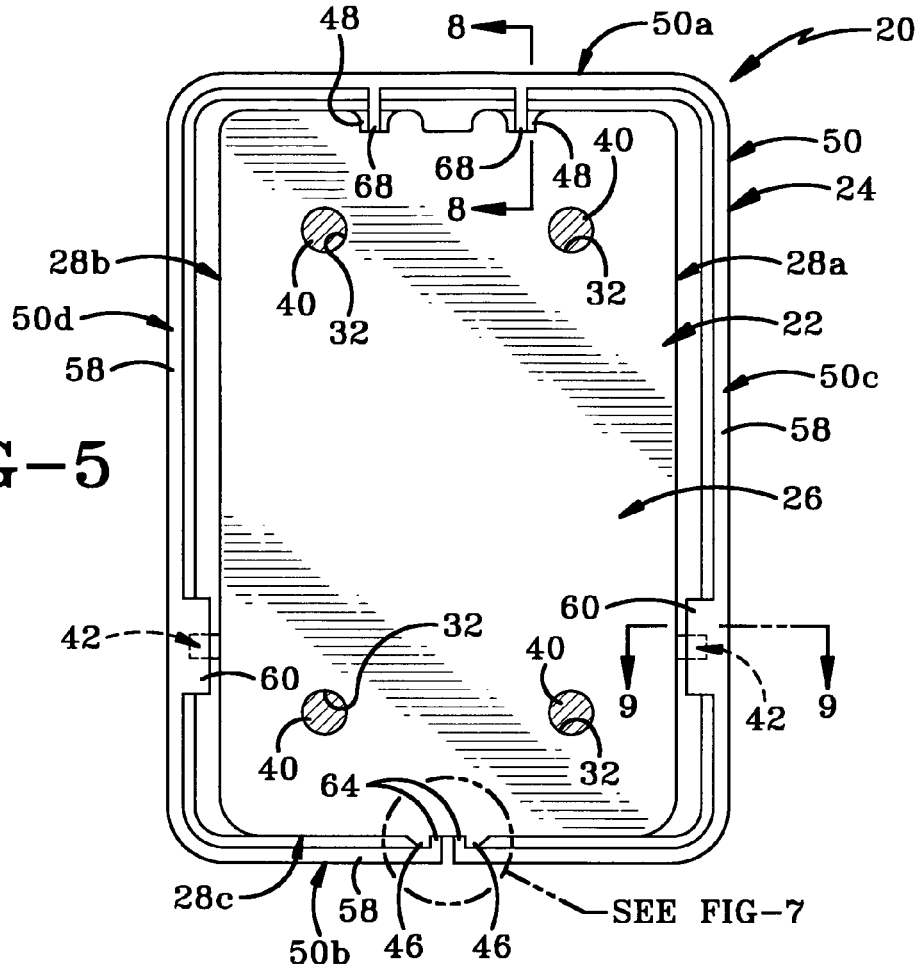
FIG. 5 is a rear view of the bracket and cover plate through line 5-5 of FIG. 2.
Figure 6:
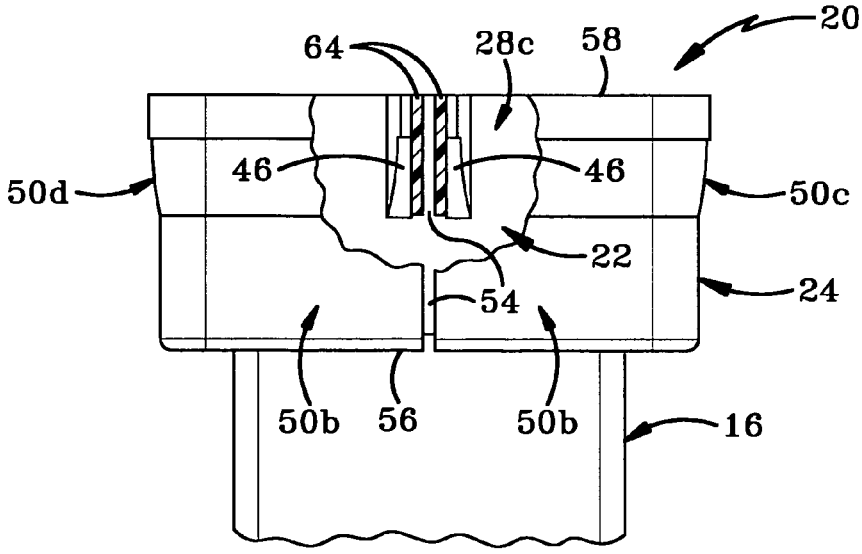
FIG. 6 is a partial cross-sectional bottom view of the cover plate and bracket.
Figure 7:
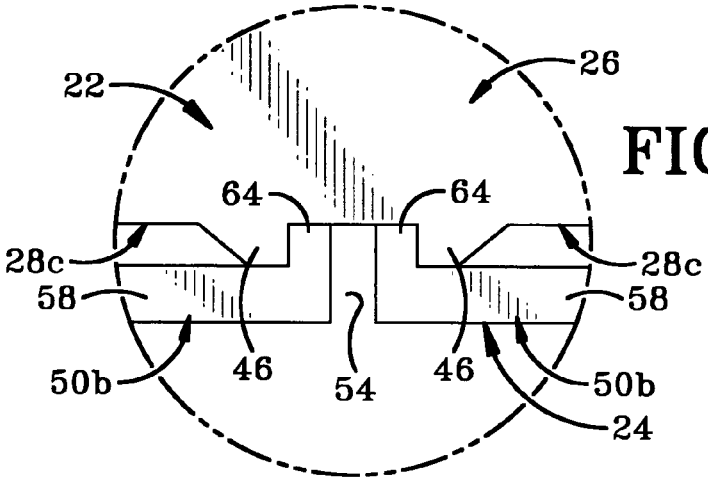
FIG. 7 is an enlargement of the highlighted area of the cover plate and bracket from FIG. 5.
Figure 8:
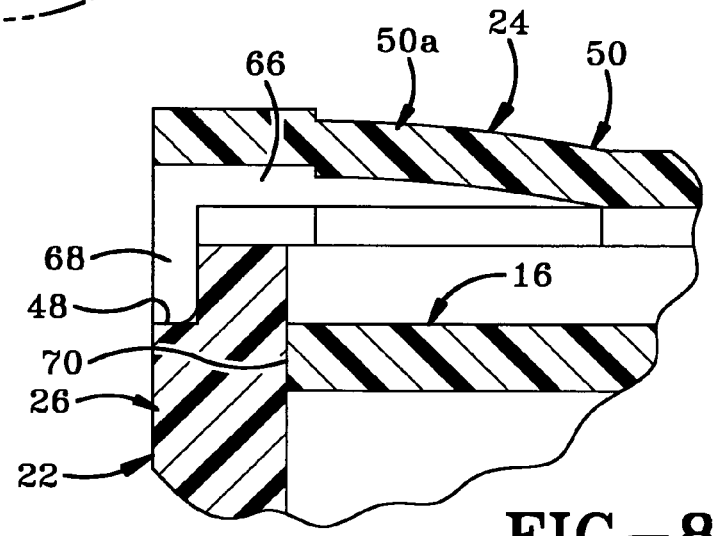
FIG. 8 is a side view through line 8-8 of FIG. 5.
Figure 9:
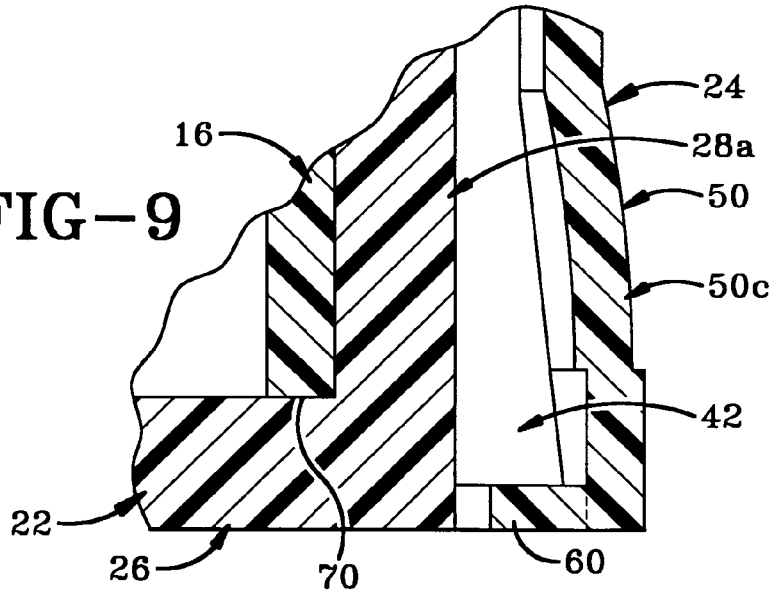
FIG. 9 is a top view through line 9-9 of FIG. 5.

Cover plate 24 is complementary shaped to surround bracket 22 and, more specifically, to encompass peripheral outer wall 28 thereof, including spanning the opening 30 between side sections 28*a* and 28*b*. Consequently, because bracket 22 is substantially U-shaped, cover plate 24 is substantially rectangular in shape. Cover plate 24 comprises a perimeter wall 50 that has a top end 50*a*, a bottom end 50*b* and sides 50*c* and 50*d* which together define an interior cavity 52 into which bracket 22 is received. The exterior surface of perimeter wall 50 may be provided with a decorative profile so as to give railing 10 a more decorative appearance. A slot 54 extends from a front edge 56 of cover plate 24 through to a back edge 58 thereof. The cover plate 24 is manufactured in such a way that it can flex and sides 50*c* and 50*d* can be pulled apart from each other as shown in FIG. 4. Tabs 60 are provided on each of sides 50*c*, 50*d* proximate back edge 58 thereof. As may be seen from FIG. 5, tabs 60 are positioned so that when cover plate 24 is snap-fitted over bracket 22, tabs 60 slide behind flanges 42. Tabs 60 will then be positioned between flanges 42 and side wall 36 of post 12. Cover plate 24 also has a lip portion 62 extending inwardly a short distance perimeter wall 50. Outer edge 44 of bracket 22 abuts lip portion 62 when cover plate 24 is snap-fitted around bracket 22. A pair of tapered tabs 64 are also provided on bottom end 50*c* alongside slot 54, with the widest part of tabs 64 being positioned proximate back edge 58 of cover plate 24. Tabs 64 are positioned to interlock with ridges 46 on bracket 22. Second tabs 66 are disposed on the interior surface of top end 50*a* of being positioned proximate back edge 58 of cover plate 24. Each second tab 66 further includes a downwardly extending projection 68 disposed proximate back edge 58.

Bracket assembly 20 is used to connect rail 16 to post 12 in the following manner. The installer selects the position on side wall 36 of post 12 where he wishes to install bracket 22. Back wall 26 is placed in abutting contact with side wall 36, preferably with opening 30 being position at the top of bracket 22. Fasteners 34, which are preferably stainless steel screws, are used to secure bracket 22 to post 12.

Figure 10:
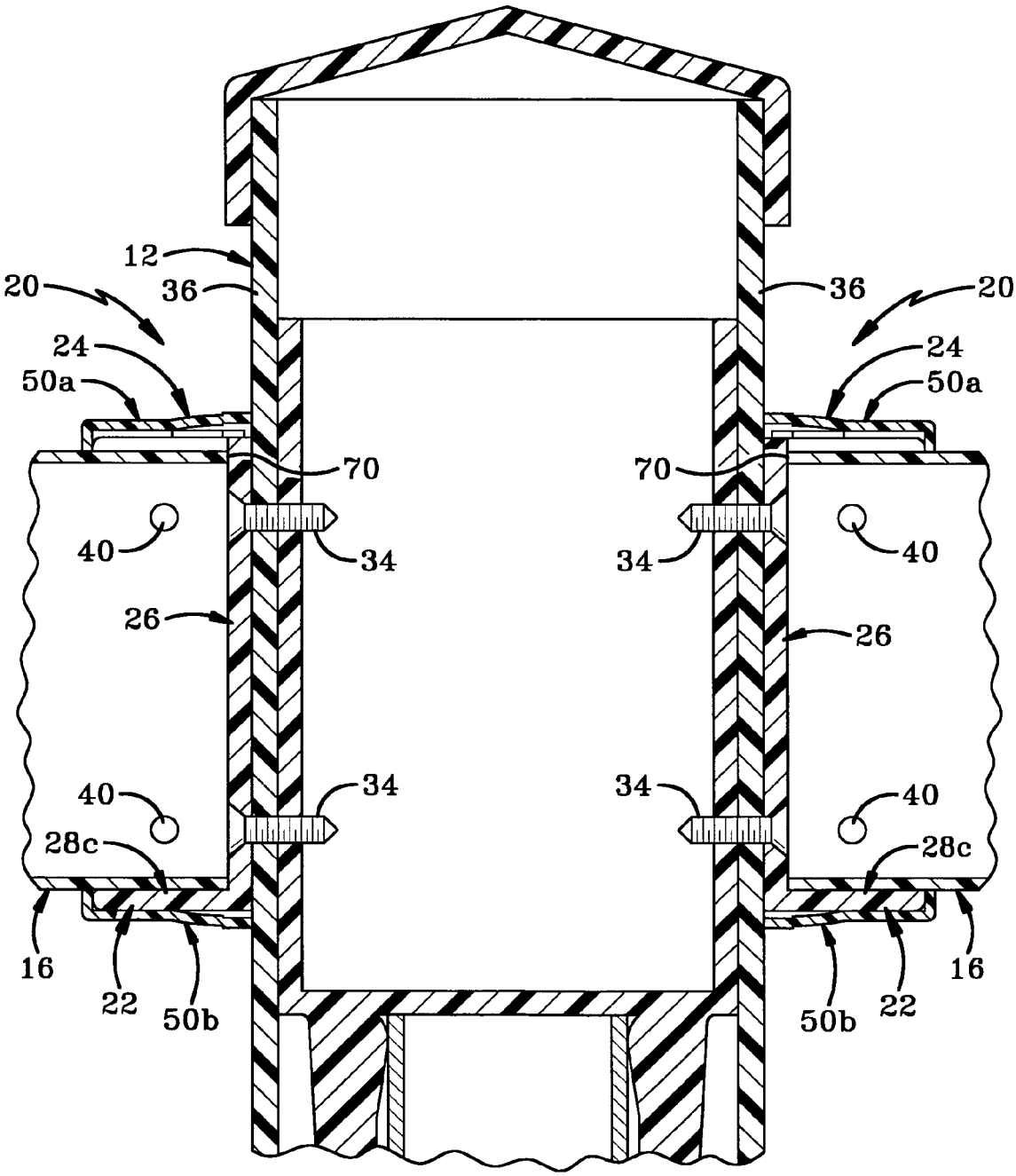
FIG. 10 is a cross-sectional front view of a post with two rails connected thereto by way of bracket assemblies in accordance with the present invention.

Rail 16 is then dropped into receptacle 27 defined by bracket 22 peripheral outer wall 28. The end 70 (FIG. 10) of rail 16 preferably is pushed into abutting contact with rear wall 26 of bracket 22. Second fasteners 40, which are preferably stainless steel screws, are then used to secure rail 16 within bracket 22.

Cover plate 24 is then positioned around bracket 22. In order to do this, side sections 50*c* and 50*d* of cover plate 24 are pulled apart (FIG. 4) and then cover plate 24 is moved downwardly over bracket 22. As the inner surface of the top end 50*a* of cover plate 24 engages edge 29 of bracket 22, projections 68 on cover plate 24 slide into notches 48 on bracket 22. The installer releases side sections 50*c*, 50*d*, which then snap inwardly toward each other and around bracket 22. When this occurs, tabs 60 slide behind flanges 42. The installer then engages side sections 50*c* and 50*d* of cover plate 24 proximate bottom end 50*b* and gently pushes side sections 50*c*, 50*d* inwardly toward each other. This causes tabs 64 to slide over ridges 46, thereby locking cover plate 24 in place. It should be noted that when in this position, cover plate 24 cannot slide outwardly away from post 12 and along rail 16. This is because projections 68 are engaged in notches 48 and tabs 60 are disposed behind flanges 42. Furthermore, side sections 50*c* and 50*d* cannot easily be moved outwardly away from each other because the tabs 64 are interlocked with ridges 46. Back edge 58 of cover plate 24 lies in abutting contact with side wall 36 of post 12, and lip 62 is in abutting contact with front edge 56 of bracket 22. All fasteners, 34 and 40 are hidden from view by cover plate 24 and the connection between rail 16 and post 12 is aesthetically pleasing. As may be seen from FIG. 10, a second bracket 22 and its associated cover plate 24 may be secured to one of the other side walls of post 12.

When cover plate 24 is positioned around bracket 22, cover plate 24 lies substantially at right angles to the horizontal axis "F-F" of bracket 22 and substantially axially aligned with longitudinal axis "E-E" of bracket 22.

In order to unlock tabs 64 from ridges 46 a thin object, such as the end of a flathead screwdriver can be inserted between a bottom wall of rail 16 and the inner surface of lip 62 and a small downward force is applied. Once tab 64 is disengaged from bracket 22, then side sections 50*c* and 50*d* are moved arcuately outwardly away from each other so that tabs 60 slide outwardly from behind flanges 42. Cover plate 24 is then slid slightly upwardly so that projections 68 slide out of slots notches 48. Cover plate 24 is then completely disengaged from bracket 22, each one of bottom sections 50*b* needs to be individually lifted over substantially prevents this arcuate motion from occurring without a reasonable amount of force being applied thereto.

Figure 11:
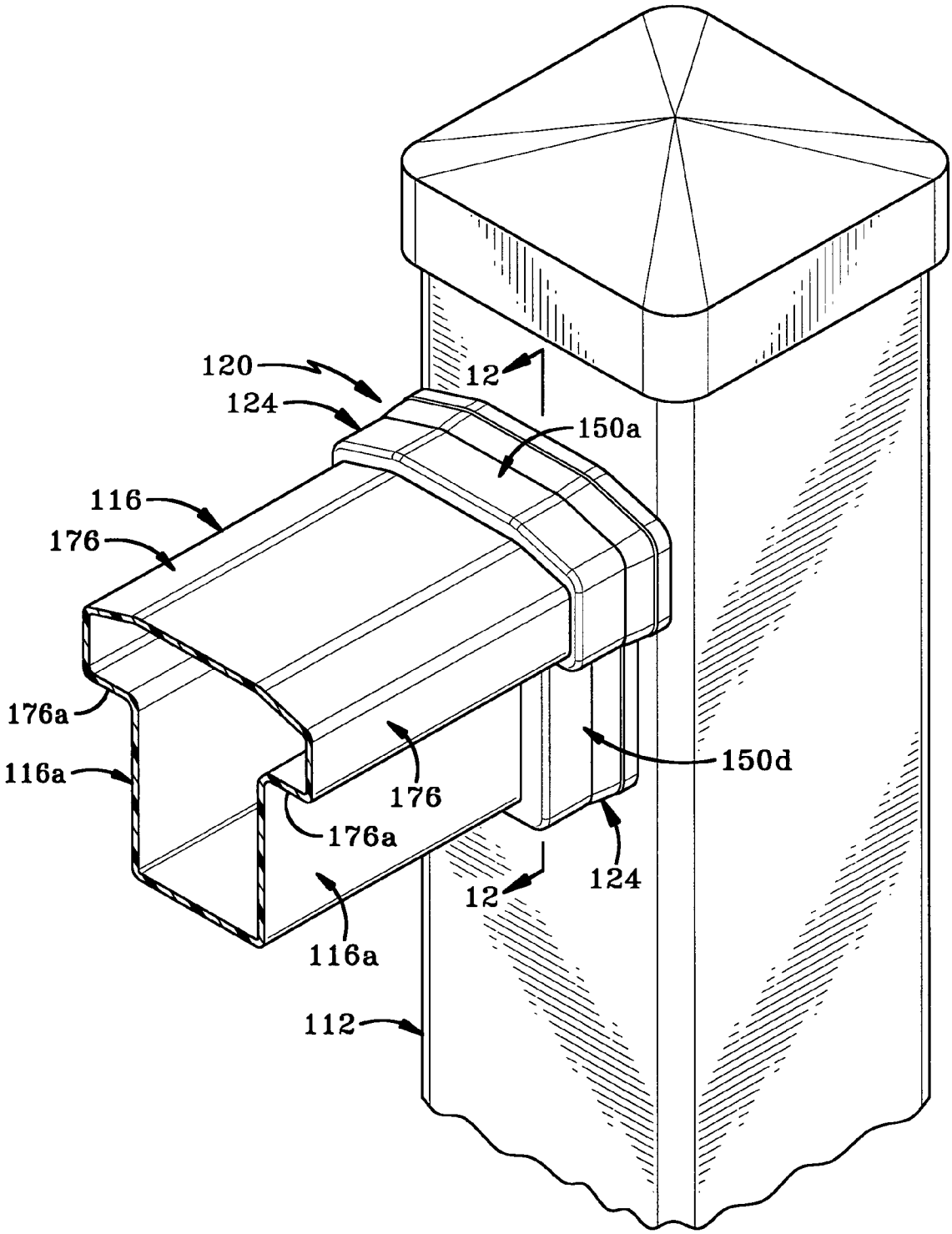
FIG. 11 is a perspective view of a second embodiment of bracket assembly in accordance with the present invention.
Figure 13:
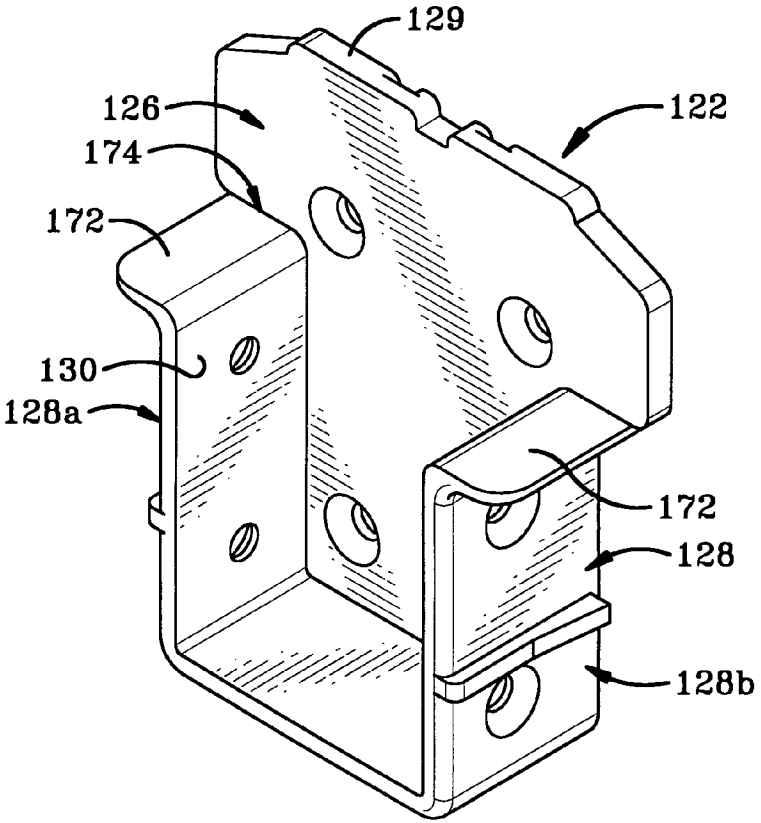
FIG. 13 is a perspective view of the bracket of the bracket assembly of FIG. 11.
Figure 12:
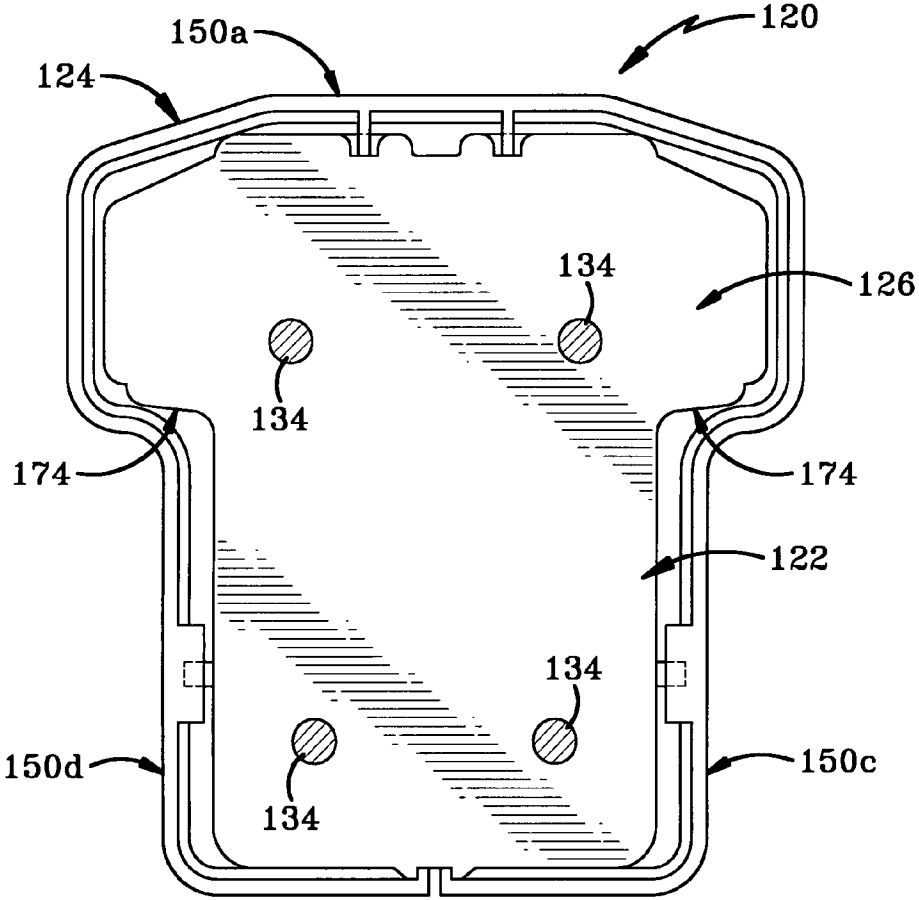
FIG. 12 is a rear view of the bracket assembly shown in FIG. 11.

Referring to FIGS. 11-13, there is shown a second embodiment of bracket assembly in accordance with the present invention and generally indicated at 120. Bracket assembly 120 is adapted to be used in association with a rail 116. Rail 116 is substantially T-shaped in cross-section and is adapted to be received within a bracket 122 mounted on a post 112. Bracket 122 includes a substantially T-shaped back wall 126 and a substantially U-shaped peripheral outer wall 128 which terminates in a flange 172 at the base of the crossbar 174 of the "T" shape on the back wall 126. All other components of bracket assembly 120 are substantially the same as those of bracket assembly 20. Bracket 122 is secured to post 112 by fasteners 134. Rail 116 gets dropped into the opening 130 between side sections 128*a* and 128*b*. The underside 176*a* of the flanges 176 on rail 116 abuts flange 172 on bracket 122. Fasteners (not shown) are then screwed into the side walls 116*a* of rail 116. Cover plate 124 is then snap fitted around bracket 122 by pulling the side sections 150*c* and 150*d* apart from each other and moving cover plate 124 downwardly until the interior surface of top end 150*a* engages upper edge 129 of bracket 122. Cover plate 124 interlocks and is secured to bracket 122 in the same manner as cover plate 24 and bracket 22.

It will be understood that while the figures illustrate bracket 22 secured to side wall 36 of post 12 with the opening 30 at the top so that rail 16 may be slid vertically into bracket 22 in the direction of arrow C, bracket 22 may be placed in any other desired orientation, e.g. with opening 30 effectively facing the front or back of the railing, or at an angle to the vertical, or even downwardly. The latter orientation is the least favored only for the reason that the end section 28*c* of bracket 22 assists in carrying the load of rail 16 and if opening 30 is disposed facing the deck planking 14, then the load of rail 16 is effectively carried by the fasteners 40, instead of a combination of the fasteners 40 and end section 28*c*.

Furthermore, while a generally rectangular shaped rail and bracket assembly; and a generally T-shaped rail and bracket assembly have been illustrated and described herein, it will be understood that the complementary bracket and rail assembly can be of any desired shape and configuration without departing from the spirit of the present invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A bracket assembly for securing an elongated rail to a post; wherein the bracket assembly comprises:

a bracket adapted to be secured to the post; said bracket having a peripheral outer surface including a bottom end section; said bracket defining a rail receiving receptacle therein; said receptacle being adapted to receive an end of the rail therein;

a spring-biased cover plate engageable around the peripheral outer surface of the bracket; said cover plate being engageable with the bracket after the rail is received therein; and wherein said cover plate has a perimeter wall comprising:

a first section, a first and a second wall extending outwardly away from the first section; said first wall terminating in a first end and said second wall terminating in a second end; said first and second ends being disposed in close proximity to each other in end to end relationship, whereby said first and second ends form a bottom wall that extends substantially across the entire bottom end section of the bracket;

a slot defined between said first and second ends and extending from a front edge to a back edge of said perimeter wall; said slot having a width; and wherein said first and second walls are movable away from each other so as to increase the width of the slot to a degree sufficient to allow the cover plate to be snap fitted around the peripheral outer surface of the bracket when the rail end is retained therein; and wherein the bracket includes a plurality of first tabs on the bottom end section and the cover plate includes a plurality of second tabs on the bottom wall; and wherein the first tabs and second tabs interlocking engage each other when the cover plate engages the bracket thereby locking the cover plate and bracket together.

2. The bracket assembly as defined in claim 1, wherein the bracket has a back wall and a peripheral outer wall extending outwardly away therefrom; and wherein said peripheral outer wall defines the rail-receiving receptacle therein; and wherein the cover plate is engageable with substantially the entire peripheral outer wall of the bracket.

3. The bracket assembly as defined in claim 2, wherein the cover plate is snap-fitted around the peripheral outer wall of the bracket.

4. The bracket assembly as defined in claim 2, wherein the peripheral outer wall of the bracket is substantially U-shaped and defines an opening therein, said opening being configured to receive the end of the rail therethrough.

5. The bracket assembly as defined in claim 4, wherein the cover plate covers the opening in the peripheral outer wall when the cover plate and bracket are engaged.

6. The bracket assembly as defined in claim 4, wherein the opening in the peripheral outer wall of the bracket is substantially equal in one of width and height to the end of the rail which the bracket is adapted to receive therein.

7. The bracket assembly as defined in claim 2, wherein the first and second ends of the first and second walls adjacent the slot are arcuately movable relative to each other.

8. The bracket assembly as defined in claim 7, wherein the first section and first and second walls further comprise a front edge that surrounds and defines an opening through which the rail is receiveable; and wherein the front edge includes a lip which lies in abutting contact with an outer edge of the peripheral outer wall of the bracket when the cover plate and bracket are engaged.

9. The bracket assembly as defined in claim 2, wherein the peripheral outer wall of the bracket includes a substantially U-shaped section.

10. The bracket assembly as defined in claim 9, wherein the cover plate is substantially rectangular in shape.

11. The bracket assembly as defined in claim 2, wherein the bracket has a back wall that is adapted to abut a side wall of the post; and wherein the back wall includes a plurality of first apertures therein, and said first apertures are adapted to each receive a fastener therethrough to secure said bracket to said post.

12. The bracket assembly as defined in claim 2, wherein the bracket includes a plurality of second apertures in the peripheral outer wall thereof; and wherein the second apertures are adapted to each receive one of a plurality of second fasteners therethrough to secure said rail to said bracket.

13. The bracket assembly as defined in claim 1, wherein at least some of the plurality of first and second tabs are tapered.

14. The bracket assembly as defined in claim 1, whereon one of the bracket and cover plate includes at least one projection thereon and the other of the bracket and cover plate includes at least one notch therein; and wherein the projection is receivable within the notch to interlock said bracket and cover plate together.

15. The bracket assembly as defined in claim 1, wherein the cover plate has a decorative profiled outer surface.

16. In combination:

a post;

a rail;

a bracket to be secured to the post; said bracket having a peripheral outer surface including a bottom end section; said bracket defining a rail receiving receptacle to receive an end of the rail therein;

a spring-biased cover plate engageable around a peripheral outer surface of the bracket; said cover plate being engageable with the bracket after the rail is received therein; wherein said cover plate has a perimeter wall comprising:

a first section, a first and a second wall extending outwardly away from the first section; said first wall terminating in a first end and said second wall terminating in a second end; said first and second ends being disposed in close proximity to each other in end to end relationship; whereby said first and second ends form a bottom wall that extends substantially across the entire bottom end section of the bracket a slot defined between said first and second ends and extending from a front edge to a back edge of said perimeter wall; said slot having a width; and wherein said first and second walls are movable away from each other so as to increase the width of the slot to a degree sufficient to allow the cover plate to be snap fitted around the peripheral outer surface of the bracket when the rail end is retained therein; and wherein the bracket includes a plurality of first tabs on the bottom end section and the cover plate includes a plurality of second tabs on the bottom wall; and wherein the first tabs and second tabs interlocking engage each other when the cover plate engages the bracket thereby locking the cover plate and bracket together.

17. The combination as defined in claim 16, wherein the bracket has a back wall and a peripheral outer wall extending outwardly away therefrom; and wherein said peripheral outer wall defines the rail-receiving receptacle therein; and wherein the cover plate is engageable with the substantially the entire peripheral outer wall of the bracket.

18. The combination as defined in claim 17, wherein the first and second ends of the first and second walls adjacent the slot are arcuately movable relative to each other.

* * * * *